US010085333B1

(12) United States Patent
Huang et al.

(10) Patent No.: US 10,085,333 B1
(45) Date of Patent: Sep. 25, 2018

(54) LED FAILURE DETECTING DEVICE

(71) Applicant: MACROBLOCK, INC., Hsinchu (TW)

(72) Inventors: Ping-Kai Huang, Hsinchu (TW); Chung-Ta Tsai, Hsinchu (TW)

(73) Assignee: Macroblock, Inc., Hsinchu (TW)

( * ) Notice: Subject to any disclaimer, the term of this patent is extended or adjusted under 35 U.S.C. 154(b) by 0 days.

(21) Appl. No.: 15/925,881

(22) Filed: Mar. 20, 2018

(30) Foreign Application Priority Data

Mar. 21, 2017 (TW) ..... 106109314 A

(51) Int. Cl.

| | |
|---|---|
| ***G09G 3/10*** | (2006.01) |
| ***H05B 37/03*** | (2006.01) |
| ***H05B 33/08*** | (2006.01) |
| ***G09G 3/3291*** | (2016.01) |
| ***G09G 3/3233*** | (2016.01) |
| ***G09G 3/3275*** | (2016.01) |
| ***G09G 3/3216*** | (2016.01) |
| *F21Y 103/10* | (2016.01) |

(52) U.S. Cl.
CPC ..... *H05B 37/03* (2013.01); *G09G 3/3216* (2013.01); *G09G 3/3233* (2013.01); *G09G 3/3275* (2013.01); *G09G 3/3291* (2013.01); *H05B 33/0884* (2013.01); *F21Y 2103/10* (2016.08)

(58) Field of Classification Search
CPC .. H05B 33/0884; H05B 37/03; G09G 3/3216; G09G 3/3233; G09G 3/3275; G09G 3/3291
USPC ..... 315/169.3; 345/77, 694
See application file for complete search history.

(56) References Cited

U.S. PATENT DOCUMENTS 6,201,520 B1 * 3/2001 Iketsu ..... G09G 3/3216 315/169.3
8,130,181 B2 * 3/2012 Jeon ..... G09G 3/3233 315/169.3
8,525,757 B2 9/2013 Nishi et al.
(Continued)

FOREIGN PATENT DOCUMENTS

CN 101661696 A 3/2010
DE 102012107766 A1 2/2013
(Continued)

OTHER PUBLICATIONS

Search Report appended to an Office Action, which was issued to Taiwanese counterpart application No. 106109313 by the TIPO dated Jan. 12, 2018, with an English translation thereof.
(Continued)

*Primary Examiner* — Tung X Le
(74) *Attorney, Agent, or Firm* — Fish & Richardson P.C.

(57) ABSTRACT

A light emitting diode (LED) failure detecting device is operatively associated with an LED array, and includes a driving circuit and a determining circuit. The driving circuit drives LED units of the LED array through scan lines and data lines of the LED array in such a way that a current flows through one of the LED units. The determining circuit selects a voltage at the data line that is coupled to said one of the LED units, and generates, based on a difference between a first sample voltage that is related to at least the selected voltage at a first time point and a second sample voltage that is related to at least the selected voltage at a second time point, a determination output indicating whether said one of the LED units is determined to have failed.

19 Claims, 6 Drawing Sheets

(56) References Cited

U.S. PATENT DOCUMENTS

| | | | | |
|---|---|---|---|---|
| 2007/0040772 | A1* | 2/2007 | Kim | G09G 3/3233 345/76 |
| 2007/0195025 | A1 | 8/2007 | Korcharz et al. | |
| 2013/0314307 | A1 | 11/2013 | Lin et al. | |
| 2014/0375704 | A1* | 12/2014 | Bi | G09G 3/3275 345/694 |

FOREIGN PATENT DOCUMENTS

| | | | |
|---|---|---|---|
| EP | 1006759 | A2 | 6/2000 |
| TW | 201349206 | A | 12/2013 |
| TW | 201410064 | A | 3/2014 |
| WO | 2008/139365 | A1 | 11/2008 |
| WO | 2014060288 | A1 | 4/2014 |

OTHER PUBLICATIONS

Search Report issued to European counterpart application No. 18162712.6 by the EPO dated Jul. 24, 2018.

* cited by examiner

LED FAILURE DETECTING DEVICE

CROSS-REFERENCE TO RELATED APPLICATION

This application claims priority of Taiwanese Patent Application No. 106109314, filed on Mar. 21, 2017.

FIELD

The disclosure relates to failure detection, and more particularly to a light emitting diode (LED) failure detecting device.

BACKGROUND

Light emitting diodes (LEDs) are widely used today in lighting and display applications. It is important to provide a device (such as that disclosed in U.S. Patent Application Publication No. 2014/0097849) for detecting LED failures in these applications, thereby informing relevant personnel of possible occurrences of LED failures in order to have failed LEDs or LED strings replaced in a timely fashion.

SUMMARY

Therefore, an object of the disclosure is to provide a light emitting diode (LED) failure detecting device that can detect a failure of an LED unit or LED.

According to an aspect of the disclosure, the LED failure detecting device is operatively associated with an LED array. The LED array includes a plurality of scan lines, a plurality of data lines, and a plurality of LED units that are arranged in a matrix with a plurality of rows and a plurality of columns. Each of the LED units has a first terminal and a second terminal, and permits current flow therethrough from the first terminal thereof to the second terminal thereof. For each of the rows of the LED units, the first terminals of the LED units are coupled to a respective one of the scan lines. For each of the columns of the LED units, the second terminals of the LED units are coupled to a respective one of the data lines. The LED failure detecting device includes a driving circuit and a determining circuit. The driving circuit is used to be coupled to the scan lines and the data lines, receives a first control input that corresponds to selection of one of the LED units, and drives the LED units based on the first control input in such a way that a current flows through said one of the LED units. The determining circuit is used to be coupled to the data lines for receiving a plurality of voltages respectively thereat, and further receives a second control input that at least corresponds to selection of one of the data lines which is coupled to said one of the LED units. The determining circuit selects, based on the second control input, one of the voltages at said one of the data lines that is coupled to said one of the LED units, and generates, based on a difference between a first sample voltage that is related to at least the selected voltage at a first time point and a second sample voltage that is related to at least the selected voltage at a second time point, a determination output that indicates whether said one of the LED units is determined to have failed.

According to another aspect of the disclosure, the LED failure detecting device is operatively associated with an LED unit. The LED unit has a first terminal and a second terminal, and permits current flow therethrough from the first terminal thereof to the second terminal thereof. The LED failure detecting device includes a driving circuit and a determining circuit. The driving circuit is used to be coupled to the second terminal of the LED unit, receives a control input, and drives the LED unit based on the control input in such a way that a current flows through the LED unit. The determining circuit is used to be coupled to the second terminal of the LED unit for receiving a voltage thereat, and generates, based on a difference between a first sample voltage that is related to at least the received voltage at a first time point and a second sample voltage that is related to at least the received voltage at a second time point, a determination output that indicates whether the LED unit is determined to have failed.

According to yet another aspect of the disclosure, the LED failure detecting device is operatively associated with an LED unit. The LED unit includes a first terminal, a second terminal, and a plurality of LEDs that are coupled in series between the first and second terminals thereof. The LED unit permits current flow from the first terminal thereof through the LEDs thereof to the second terminal thereof. The LED failure detecting device includes a driving circuit and a determining circuit. The driving circuit is used to be coupled to the second terminal of the LED unit, receives a control input, and drives the LED unit based on the control input in such a way that a current flows through the LED unit. The determining circuit is used to be coupled to the LEDs, generates a plurality of difference voltages that respectively correspond to respective voltages across the LEDs, and generates, based on a plurality of differences each between a respective first sample voltage that is a respective one of the difference voltages at a first time point and a respective second sample voltage that is the respective one of the difference voltages at a second time point, a determination output that indicates whether each of the LEDs is determined to have failed.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
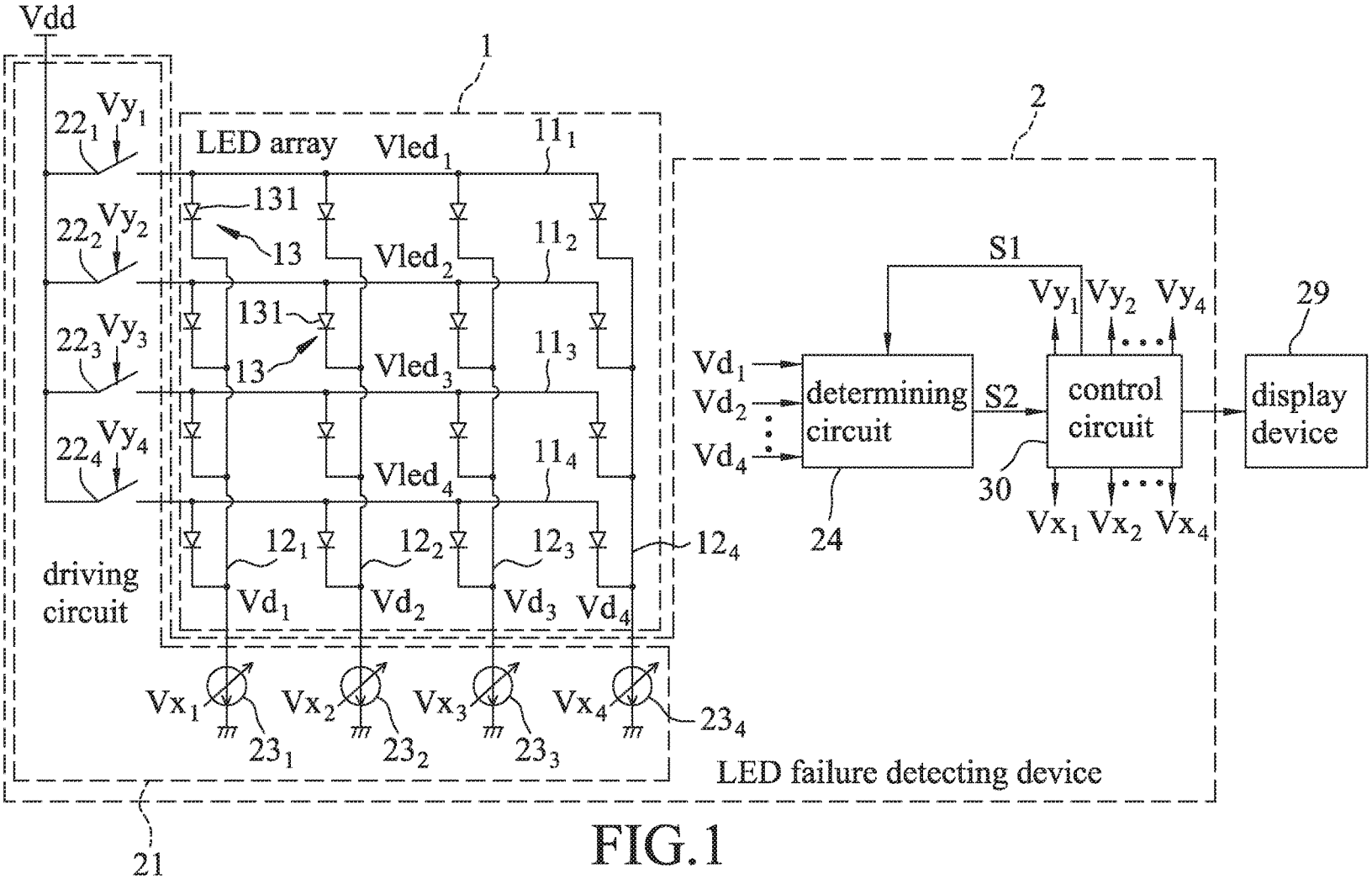
FIG. 1 is a circuit block diagram illustrating a first embodiment of a light emitting diode (LED) failure detecting device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, a first embodiment of a light emitting diode (LED) failure detecting device 2 according to the disclosure is operatively associated with an LED array 1 and a display device 29. The LED array 1 includes a number (M) of scan lines ($\mathbf{11}_1$-$\mathbf{11}_M$), a number (N) of data lines ($\mathbf{12}_1$-$\mathbf{12}_N$), and a number (M×N) of LED units 13 that are arranged in a matrix with a number (M) of rows and a number (N) of columns, where M≥2 and N≥2. For illustration purposes, M=4 and N=4 in this embodiment. Each LED unit 13 includes a first terminal, a second terminal, and a number (P) of LEDs 131 that are coupled between the first and second terminals thereof, where P≥1. When P≥2, the LEDs 131 of each LED unit 13 are coupled in series to form an LED string. For illustration purposes, P=1 in this embodiment. Each LED unit 13 permits current flow from the first terminal thereof through the LED 131 thereof to the second terminal thereof. For each row of the LED units 13, the first terminals of the LED units 13 of the row are coupled to a respective scan line $\mathbf{11}_1$-$\mathbf{11}_4$. For each column of the LED units 13, the second terminals of the LED units 13 of the column are coupled to a respective data line $\mathbf{12}_1$-$\mathbf{12}_4$.

The LED failure detecting device 2 of this embodiment includes a driving circuit 21, a determining circuit 24 and a control circuit 30.

The driving circuit 21 is used to be coupled to the scan lines $\mathbf{11}_1$-$\mathbf{11}_4$ and the data lines $\mathbf{12}_1$-$\mathbf{12}_4$, and receives a first control input that corresponds to selection of one of the LED units 13 (e.g., the LED unit 13 that is coupled to an $m^{th}$ one of the scan lines ($\mathbf{11}_m$) and an $n^{th}$ one of the data lines ($\mathbf{12}_n$), where 1≤m≤M (1≤m≤4 in this embodiment) and 1≤n≤N (1≤n≤4 in this embodiment)). The driving circuit 21 drives the LED units 13 based on the first control input in such a way that a current flows through said one of the LED units 13 (hereinafter referred to as the target LED unit 13 for simplicity), and that no current flows through each remaining one of the LED units 13.

The determining circuit 24 is used to be coupled to the data lines $\mathbf{12}_1$-$\mathbf{12}_4$ for receiving a number (N) (four in this embodiment) of first voltages ($Vd_1$-$Vd_4$) respectively thereat, and further receives a second control input (S1) that corresponds to selection of the data line ($\mathbf{12}_n$) which is coupled to the target LED unit 13. The determining circuit 24 selects, based on the second control input (S1), one of the first voltages ($Vd_n$) which is at the data line ($\mathbf{12}_n$) that is coupled to the target LED unit 13, and generates, based on a difference between a first sample voltage that is related to the selected first voltage ($Vd_n$) at a first time point and a second sample voltage that is related to the selected first voltage ($Vd_n$) at a second time point, a determination output (S2) that indicates whether the target LED unit 13 is determined to have failed.

The control circuit 30 is coupled to the driving circuit 21 and the determining circuit 24, and is used to be coupled further to the display device 29. The control circuit 30 controls the driving circuit 21 and the determining circuit 24 in such a way that the LED units 13 take turns to serve as the target LED unit, and that the determination output (S2) indicates the respective states (having failed or not having failed) of the LED units 13 one by one. For each LED unit 13, the control circuit 30 performs the following: (a) generating, for receipt by the driving circuit 21, the first control input that corresponds to the selection of the LED unit 13 as the target LED unit; (b) generating, for receipt by the determining circuit 24, the second control input (S1) that corresponds to the selection of the data line ($\mathbf{12}_n$) which is coupled to the target LED unit 13; (c) receiving the determination output (S2) from the determining circuit 24; and (d) generating, for receipt by the display device 29, a detection output based on the selection of the target LED unit 13 and on the determination output (S2) in such a way that the display device 29 can display the position of the target LED unit 13 in the LED array 1 and the state (having failed or not having failed) of the target LED unit 13.

In this embodiment, the first control input includes a number (M) (four in this embodiment) of switching control signals ($Vy_1$-$Vy_4$) and a number (N) (four in this embodiment) of current control signals ($Vx_1$-$Vx_4$), and the driving circuit 21 includes a number (M) (four in this embodiment) of switches $\mathbf{22}_1$-$\mathbf{22}_4$ and a number (N) (four in this embodiment) of current sources $\mathbf{23}_1$-$\mathbf{23}_4$. Each switch $\mathbf{22}_1$-$\mathbf{22}_4$ has a first terminal that is used to receive a supply voltage (Vdd), a second terminal that is used to be coupled to a respective scan line $\mathbf{11}_1$-$\mathbf{11}_4$, and a control terminal that is coupled to the control circuit 30 for receiving a respective switching control signal ($Vy_1$-$Vy_4$) therefrom. Each current source $\mathbf{23}_1$-$\mathbf{23}_4$ is coupled to the control circuit 30 for receiving a respective current control signal ($Vx_1$-$Vx_4$) therefrom, generates a respective driving current signal based on the respective current control signal ($Vx_1$-$Vx_4$), and is used to be coupled further to a respective data line $\mathbf{12}_1$-$\mathbf{12}_4$ for providing the respective driving current signal thereto. For the LED unit 13 that is coupled to the scan line $\mathbf{11}_i$ and the data line $\mathbf{12}_j$, a current flows through the LED unit 13 when the switch $\mathbf{22}_i$ conducts while the driving current signal generated by the current source $\mathbf{23}_j$ is non-zero, and no current flows through the LED unit 13 otherwise, where 1≤i≤M (1≤i≤4 in this embodiment) and 1≤j≤N (1≤j≤4 in this embodiment).

Figure 2:
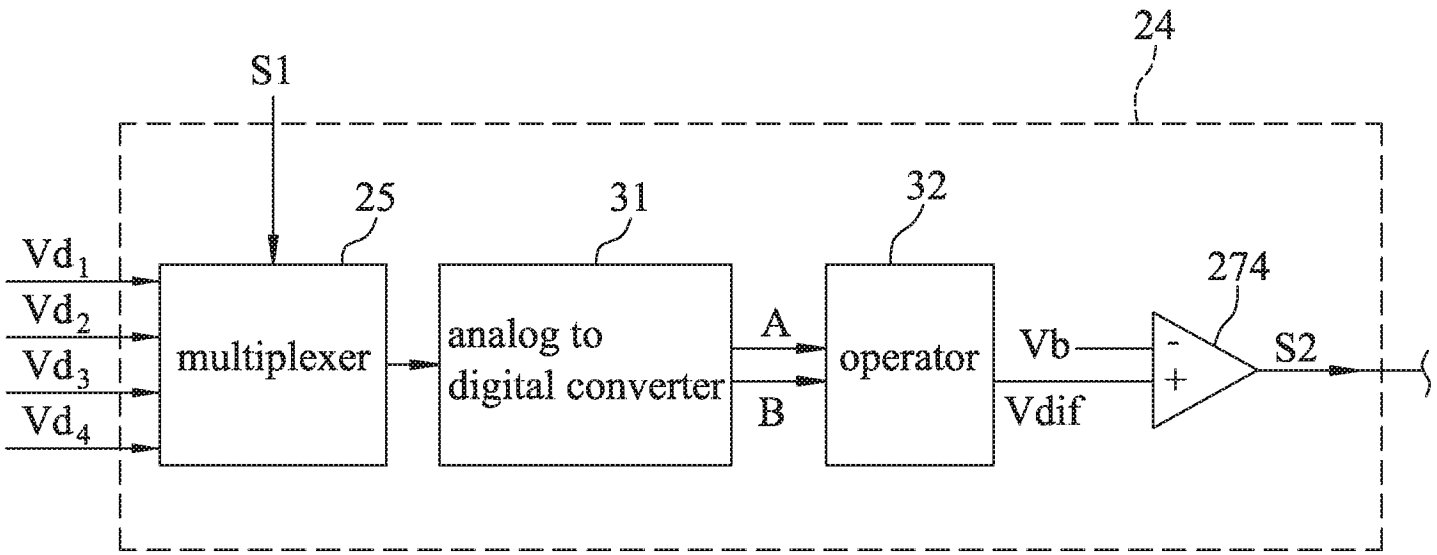
FIG. 2 is a circuit block diagram illustrating a determining circuit of the first embodiment.

Referring to FIGS. 1 and 2, in this embodiment, the first sample voltage is the selected first voltage ($Vd_n$) at the first time point, the second sample voltage is the selected first voltage ($Vd_n$) at the second time point, and the determining circuit 24 includes a multiplexer 25, an analog to digital converter 31, an operator 32 and a comparator 274 as shown in FIG. 2. The multiplexer 25 is used to be coupled to the data lines ($\mathbf{12}_1$-$\mathbf{12}_4$) for receiving the first voltages ($Vd_1$-$Vd_4$) respectively thereat, is coupled further to the control circuit 30 for receiving the second control input (S1) therefrom, and outputs, based on the second control input (S1) to serve as the selected first voltage, the first voltage ($Vd_n$) at the data line ($\mathbf{12}_n$) that is coupled to the target LED unit 13. The analog to digital converter 31 is coupled to the multiplexer 25 for receiving the selected first voltage ($Vd_n$) therefrom, and performs analog to digital conversion on the selected first voltage ($Vd_n$) to generate a first voltage value (A) and a second voltage value (B) that respectively correspond to the first and second sample voltages. The operator 32 is coupled to the analog to digital converter 31 for receiving the first and second voltage values (A, B) therefrom, and obtains a difference between the first and second voltage values (A, B) to generate a difference voltage value (Vdif) that corresponds to the difference between the first and second sample voltages (e.g., Vdif=|A−B|). The comparator 274 is coupled to the operator 32 for receiving the difference voltage value (Vdif) therefrom, is used to further receive a predetermined threshold voltage value (Vb), and compares the difference voltage value (Vdif) with the predetermined threshold voltage value (Vb) to generate the determination output (S2). As an example, when the difference voltage value (Vdif) is not greater than the predetermined threshold voltage value (Vb), the determination output (S2) is at a logic low level to indicate that the target LED unit 13 is determined not to have failed; and when the difference voltage value (Vdif) is greater than the predetermined threshold voltage value (Vb) (e.g., due to a short circuit failure or an open circuit failure of the target LED unit 13), the determination output (S2) is at a logic high level to indicate that the target LED unit 13 is determined to have failed.

In view of the above, for the first embodiment, by virtue of the determining circuit 24 that generates the determination output (S2) which indicates whether the target LED unit 13 is determined to have failed, relevant personnel can be informed of possible occurrences of LED failures in order to have the failed LED units 13 replaced in a timely fashion.

Figure 3:
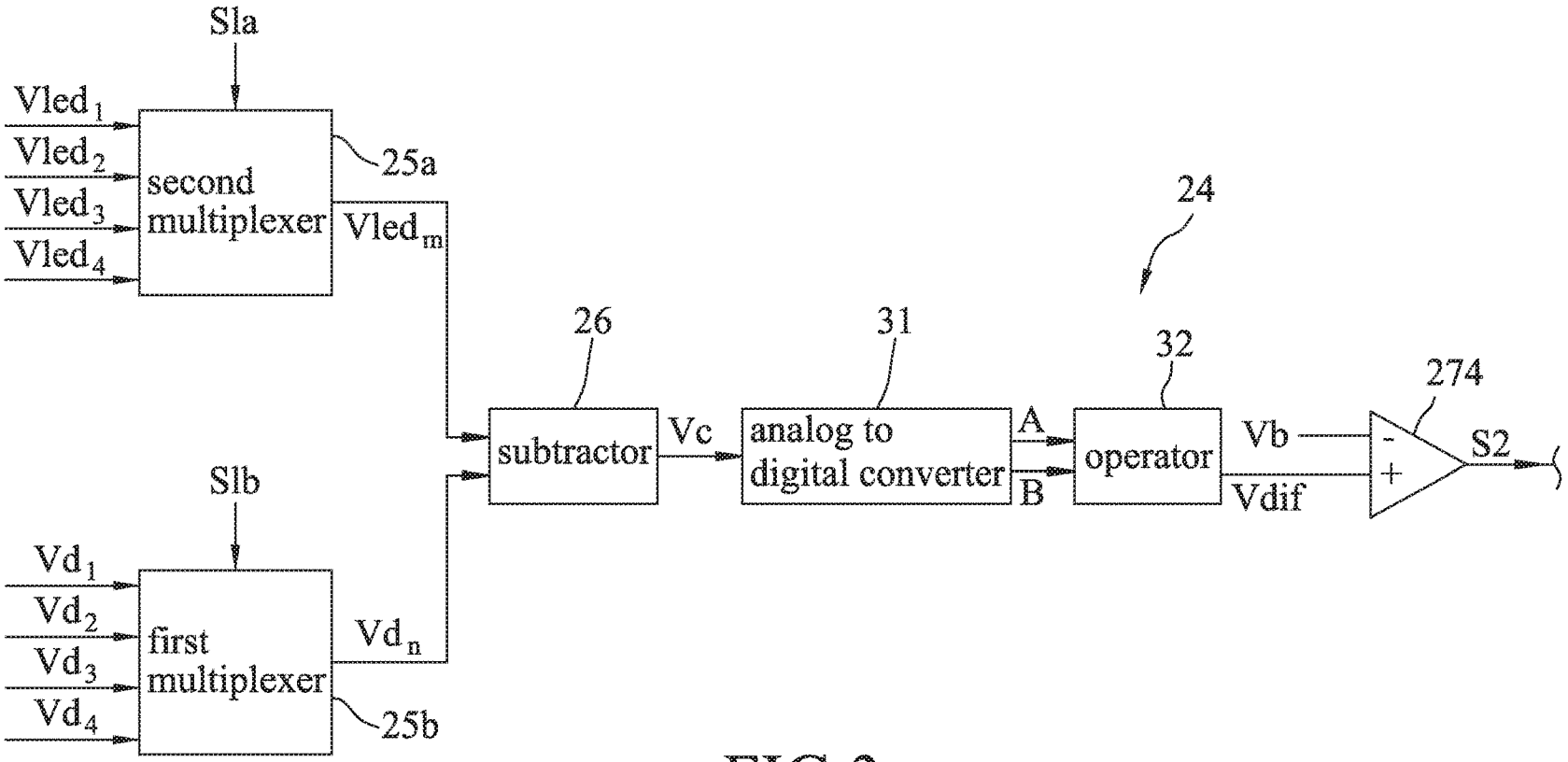
FIG. 3 is a circuit block diagram illustrating a determining circuit of a second embodiment of the LED failure detecting device according to the disclosure.

Referring to FIGS. 1 and 3, a second embodiment of the LED failure detecting device 2 according to the disclosure is a modification of the first embodiment, and differs from the first embodiment in that: (a) the second control input (S1) further corresponds to selection of the scan line ($\mathbf{11}_m$) that is coupled to the target LED unit 13; (b) the determining circuit 24 is used to be coupled further to the scan lines $\mathbf{11}_1$-$\mathbf{11}_4$ for receiving a number (M) (four in the second embodiment) of second voltages ($Vled_1$-$Vled_4$) respectively thereat, and selects, based on the second control input (S1), one of the second voltages ($Vled_m$) which is at the scan line ($\mathbf{11}_m$) that is coupled to the target LED unit 13; (c) the first sample voltage is related further to the selected second voltage ($Vled_m$) at the first time point; and (d) the second sample voltage is related further to the selected second voltage ($Vled_m$) at the second time point.

In the second embodiment, the first sample voltage is a difference between the selected first and second voltages ($Vd_n$, $Vled_m$) at the first time point; the second sample voltage is a difference between the selected first and second voltages ($Vd_n$, $Vled_m$) at the second time point; the second control input (S1) includes a first control signal (S1*b*) that corresponds to the selection of the data line ($\mathbf{12}_n$) which is coupled to the target LED unit 13, and a second control signal (S1*a*) that corresponds to the selection of the scan line ($\mathbf{11}_m$) which is coupled to the target LED unit 13; and the determining circuit 24 includes a first multiplexer (25*b*), a second multiplexer (25*a*), a subtractor 26, an analog to digital converter 31, an operator 32 and a comparator 274 as shown in FIG. 3. The first multiplexer (25*b*) is used to be coupled to the data lines ($\mathbf{12}_1$-$\mathbf{12}_4$) for receiving the first voltages ($Vd_1$-$Vd_4$) respectively thereat, is coupled further to the control circuit 30 for receiving the first control signal (S1*b*) therefrom, and outputs, based on the first control signal (S1*b*) to serve as the selected first voltage, the first voltage ($Vd_n$) at the data line ($\mathbf{12}_n$) that is coupled to the target LED unit 13. The second multiplexer (25*a*) is used to be coupled to the scan lines ($\mathbf{11}_1$-$\mathbf{11}_4$) for receiving the second voltages ($Vled_1$-$Vled_4$) respectively thereat, is coupled further to the control circuit 30 for receiving the second control signal (S1*a*) therefrom, and outputs, based on the second control signal (S1*a*) to serve as the selected second voltage, the second voltage ($Vled_m$) at the scan line ($\mathbf{11}_m$) that is coupled to the target LED unit 13. The subtractor 26 is coupled to the first and second multiplexers (25*b*, 25*a*) for receiving the selected first and second voltages ($Vd_n$, $Vled_m$) respectively therefrom, and obtains a difference between the selected first and second voltages ($Vd_n$, $Vled_m$) to generate a difference voltage (Vc) (e.g., $Vc=Vled_m-Vd_n$) that is correlated to a voltage across the target LED unit 13. The analog to digital converter 31 is coupled to the subtractor 26 for receiving the difference voltage (Vc) therefrom, and performs analog to digital conversion on the difference voltage (Vc) to generate a first voltage value (A) and a second voltage value (B) that respectively correspond to the first and second sample voltages. The operator 32 is coupled to the analog to digital converter 31 for receiving the first and second voltage values (A, B) therefrom, and obtains a difference between the first and second voltage values (A, B) to generate a difference voltage value (Vdif) that corresponds to the difference between the first and second sample voltages (e.g., $Vdif=|A-B|$). The comparator 274 is coupled to the operator 32 for receiving the difference voltage value (Vdif) therefrom, is used to further receive a predetermined threshold voltage value (Vb), and is coupled further to the control circuit 30. The comparator 274 compares the difference voltage value (Vdif) with the predetermined threshold voltage value (Vb) to generate the determination output (S2) for receipt by the control circuit 30. In an example, when the difference voltage value (Vdif) is not greater than the predetermined threshold voltage value (Vb), the determination output (S2) is at a logic low level to indicate that the target LED unit 13 is determined to not have failed; and when the difference voltage value (Vdif) is greater than the predetermined threshold voltage value (Vb), the determination output (S2) is at a logic high level to indicate that the target LED unit 13 is determined to have failed.

Figure 4:
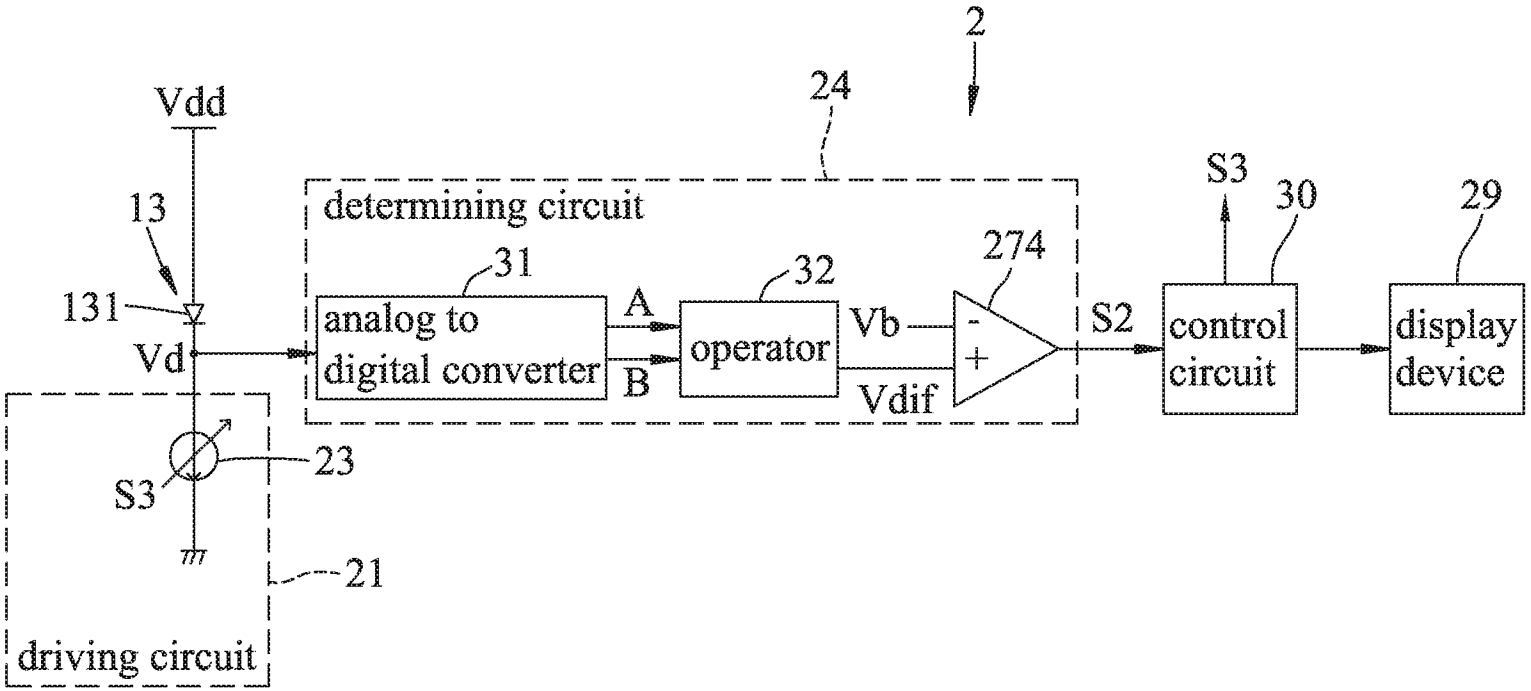
FIG. 4 is a circuit block diagram illustrating a third embodiment of the LED failure detecting device according to the disclosure.

Referring to FIG. 4, a third embodiment of the LED failure detecting device 2 according to the disclosure is operatively associated with an LED unit 13 and a display device 29. The LED unit 13 includes a first terminal that receives a supply voltage (Vdd), a second terminal, and a number (P) of LEDs 131 that are coupled between the first and second terminals thereof, where $P\geq1$. When $P\geq2$, the LEDs 131 are coupled in series to form an LED string. For illustration purposes, P=1 in this embodiment. The LED unit 13 permits current flow from the first terminal thereof through the LED 131 thereof to the second terminal thereof.

The LED failure detecting device 2 of this embodiment includes a driving circuit 21, a determining circuit 24 and a control circuit 30.

The driving circuit 21 is used to be coupled to the second terminal of the LED unit 13, receives a control input (S3), and drives the LED unit 13 based on the control input (S3) in such a way that a current flows through the LED unit 13.

In this embodiment, the driving circuit 21 includes a current source 23. The current source 23 receives the control input (S3), generates a driving current signal based on the control input (S3), and is used to be coupled to the second terminal of the LED unit 13 for providing the driving current signal thereto. A current flows through the LED unit 13 when the driving current signal is non-zero, and no current flows through the LED unit 13 otherwise.

The determining circuit 24 is used to be coupled to the second terminal of the LED unit 13 for receiving a first voltage (Vd) thereat, and generates, based on a difference between a first sample voltage that is related to the first voltage (Vd) at a first time point and a second sample voltage that is related to the first voltage (Vd) at a second time point, a determination output (S2) that indicates whether the LED unit 13 is determined to have failed.

In this embodiment, the first sample voltage is the first voltage (Vd) at the first time point, the second sample voltage is the first voltage (Vd) at the second time point, and the determining circuit 24 includes an analog to digital converter 31, an operator 32 and a comparator 274. The analog to digital converter 31 is used to be coupled to the second terminal of the LED unit 13 for receiving the first voltage (Vd) thereat, and performs analog to digital conversion on the first voltage (Vd) to generate a first voltage value (A) and a second voltage value (B) that respectively correspond to the first and second sample voltages. The operator 32 is coupled to the analog to digital converter 31 for receiving the first and second voltage values (A, B) therefrom, and obtains a difference between the first and second voltage values (A, B) to generate a difference voltage value (Vdif) that corresponds to the difference between the first and second sample voltages (e.g., Vdif=|A−B|). The comparator 274 is coupled to the operator 32 for receiving the difference voltage value (Vdif) therefrom, is used to further receive a predetermined threshold voltage value (Vb), and compares the difference voltage value (Vdif) with the predetermined threshold voltage value (Vb) to generate the determination output (S2). In an example, when the difference voltage value (Vdif) is not greater than the predetermined threshold voltage value (Vb), the determination output (S2) is at a logic low level to indicate that the LED unit 13 is determined to not have failed; and when the difference voltage value (Vdif) is greater than the predetermined threshold voltage value (Vb), the determination output (S2) is at a logic high level to indicate that the LED unit 13 is determined to have failed.

The control circuit 30 is coupled to the current source 23 and the comparator 274, and is used to be coupled further to the display device 29. The control circuit 30 generates the control input (S3) for receipt by the current source 23, receives the determination output (S2) from the comparator 274, and generates, for receipt by the display device 29, a detection output based on the determination output (S2) in such a way that the display device 29 can display the state (having failed or not having failed) of the LED unit 13.

In view of the above, for the third embodiment, by virtue of the determining circuit 24 that generates the determination output (S2) which indicates whether the LED unit 13 is determined to have failed, relevant personnel can be informed of possible occurrence of an LED failure in order to have the failed LED unit 13 replaced in a timely fashion.

Figure 5:
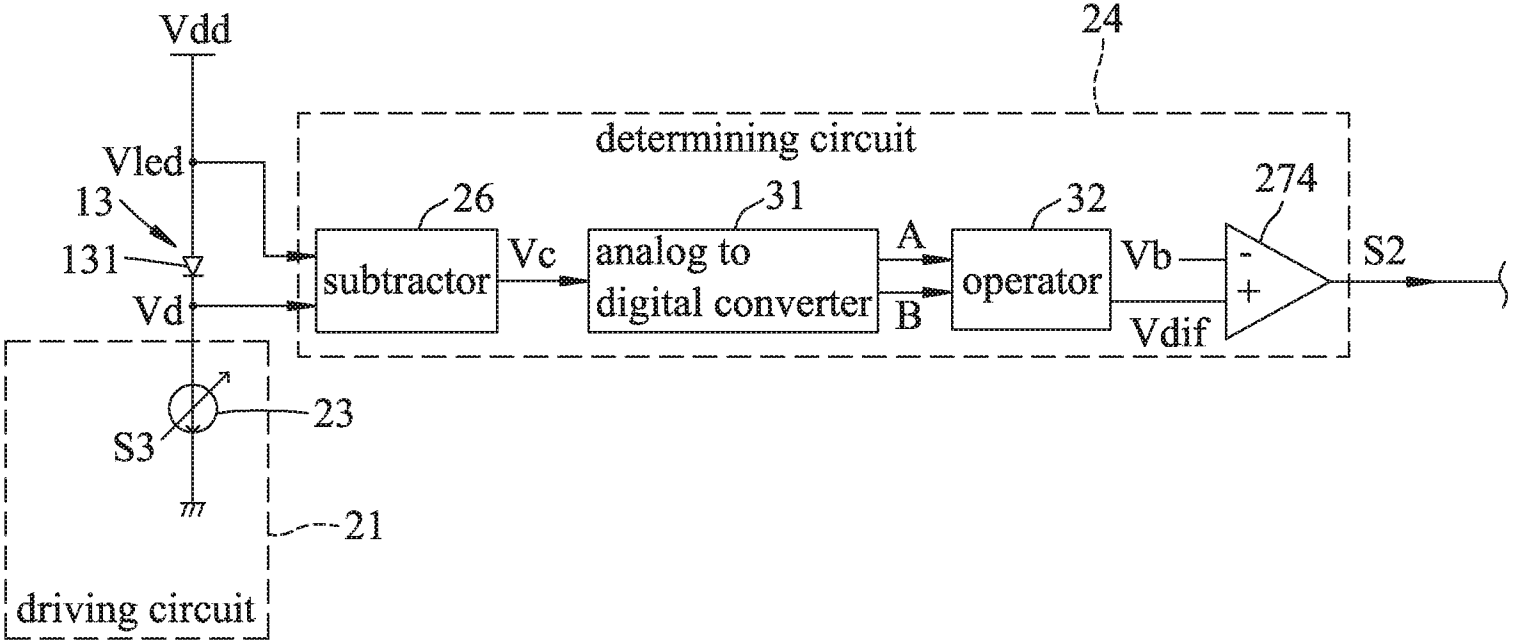
FIG. 5 is a circuit block diagram illustrating a determining circuit of a fourth embodiment of the LED failure detecting device according to the disclosure.

Referring to FIG. 5, a fourth embodiment of the LED failure detecting device according to the disclosure is a modification of the third embodiment, and differs from the third embodiment in that: (a) the determining circuit 24 is used to be coupled further to the first terminal of the LED unit 13 for receiving a second voltage (Vled) thereat; (b) the first sample voltage is related further to the second voltage (Vled) at the first time point; and (c) the second sample voltage is related further to the second voltage (Vled) at the second time point.

In the fourth embodiment, the first sample voltage is a difference between the first and second voltages (Vd, Vled) at the first time point, the second sample voltage is a difference between the first and second voltages (Vd, Vled) at the second time point, and the determining circuit 24 includes a subtractor 26, an analog to digital converter 31, an operator 32 and a comparator 274. The subtractor 26 is used to be coupled to the first and second terminals of the LED unit 13 for receiving the first and second voltages (Vd, Vled) respectively thereat, and obtains a difference between the first and second voltages (Vd, Vled) to generate a difference voltage (Vc) (e.g., Vc=Vled−Vd) that is correlated to a voltage across the LED unit 13. The analog to digital converter 31 is coupled to the subtractor 26 for receiving the difference voltage (Vc) therefrom, and performs analog to digital conversion on the difference voltage (Vc) to generate a first voltage value (A) and a second voltage value (B) that respectively correspond to the first and second sample voltages. The operator 32 is coupled to the analog to digital converter 31 for receiving the first and second voltage values (A, B) therefrom, and obtains a difference between the first and second voltage values (A, B) to generate a difference voltage value (Vdif) that corresponds to the difference between the first and second sample voltages (e.g., Vdif=|A−B|). The comparator 274 is coupled to the operator 32 for receiving the difference voltage value (Vdif) therefrom, is used to further receive a predetermined threshold voltage value (Vb), and is coupled further to the control circuit 30 (see FIG. 4). The comparator 274 compares the difference voltage value (Vdif) with the predetermined threshold voltage value (Vb) to generate the determination output (S2) for receipt by the control circuit 30 (see FIG. 4). In an example, like all previous examples, when the difference voltage value (Vdif) is not greater than the predetermined threshold voltage value (Vb), the determination output (S2) is at the logic low level; and when the difference voltage value (Vdif) is greater than the predetermined threshold voltage value (Vb), the determination output (S2) is at the logic high level.

Figure 6:
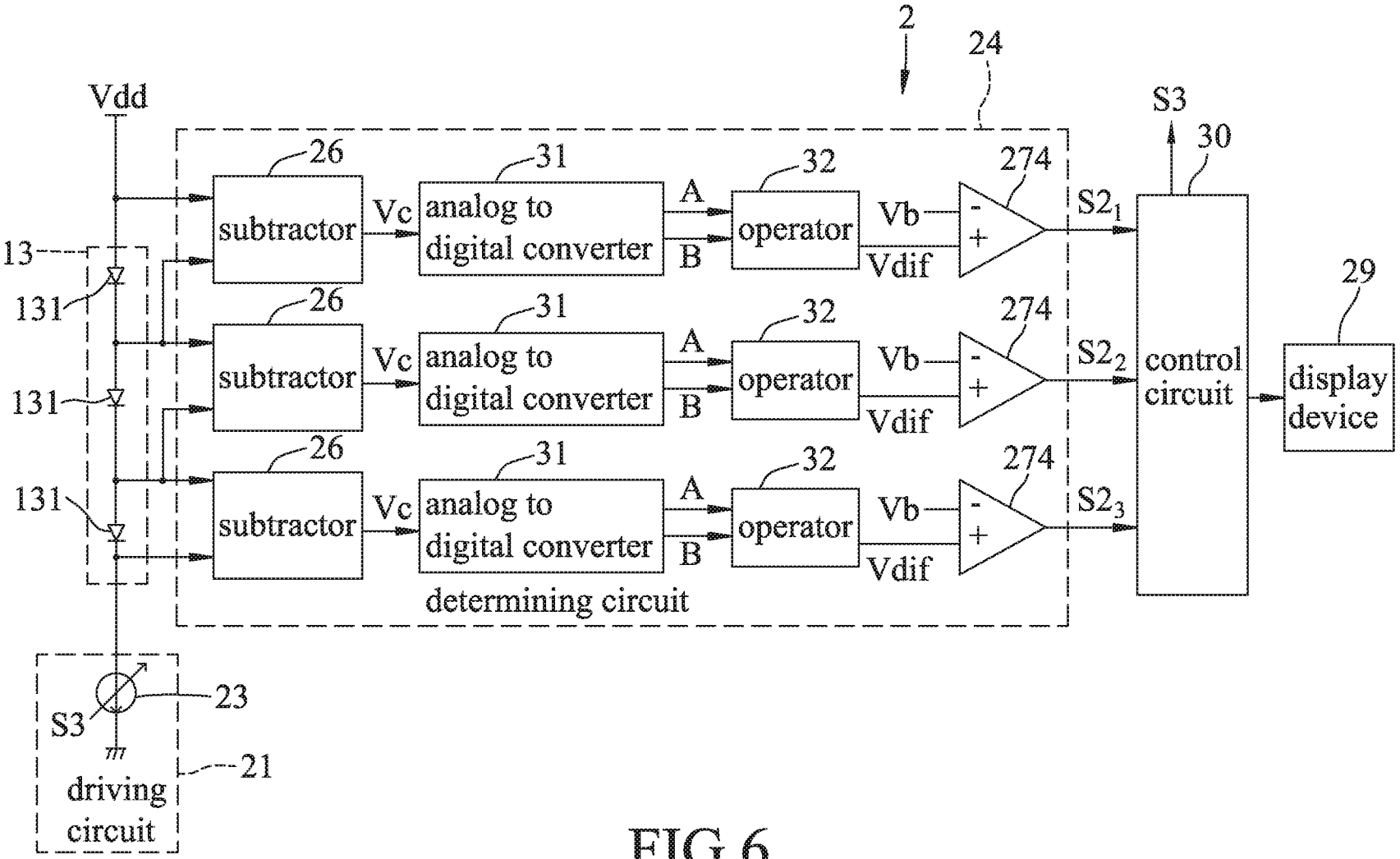
FIG. 6 is a circuit block diagram illustrating a fifth embodiment of the LED failure detecting device according to the disclosure.

Referring to FIG. 6, a fifth embodiment of the LED failure detecting device 2 according to the disclosure is operatively associated with an LED unit 13 and a display device 29. The LED unit 13 includes a first terminal that receives a supply voltage (Vdd), a second terminal, and a number (P) of LEDs 131 that are coupled is series between the first and second terminals of the LED unit 13, where P≥2. For illustration purposes, P=3 in this embodiment. Each LED 131 has an anode and a cathode. The LED unit 13 permits current flow from the first terminal thereof through the LEDs 131 thereof to the second terminal thereof.

The LED failure detecting device 2 of this embodiment includes a driving circuit 21, a determining circuit 24 and a control circuit 30.

The driving circuit 21 is used to be coupled to the second terminal of the LED unit 13, receives a control input (S3), and drives the LED unit 13 based on the control input (S3) in such a way that a current flows through the LED unit 13.

In this embodiment, the driving circuit 21 includes a current source 23. The current source 23 receives the control input (S3), generates a driving current signal based on the control input (S3), and is used to be coupled to the second terminal of the LED unit 13 for providing the driving current signal thereto. A current flows through the LED unit 13 when the driving current signal is non-zero, and no current flows through the LED unit 13 otherwise.

The determining circuit 24 is used to be coupled to the LEDs 131, generates a number (P) (three in this embodiment) of difference voltages (Vc) that respectively correspond to respective voltages across the LEDs 131, and generates, based on a number (P) (three in this embodiment) of differences each between a respective first sample voltage (which is a respective difference voltage (Vc) at a first time point) and a respective second sample voltage (which is the respective difference voltage (Vc) at a second time point), a determination output that indicates whether each of the LEDs 131 is determined to have failed.

In this embodiment, the determining circuit 24 includes a number (P) (three in this embodiment) of subtractors 26, a number (P) (three in this embodiment) of analog to digital converters 31, a number (P) (three in this embodiment) of operators 32 and a number (P) (three in this embodiment) of comparators 274. Each subtractor 26 is used to be coupled to the anode and the cathode of a respective LED 131 for receiving two terminal voltages respectively thereat, and obtains a difference between the terminal voltages to generate the difference voltage (Vc) that corresponds to the voltage across the respective LED 131. Each analog to digital converter 31 is coupled to a respective subtractor 26 for receiving the respective difference voltage (Vc) therefrom, and performs analog to digital conversion on the respective difference voltage (Vc) to generate a respective first voltage value (A) and a respective second voltage value (B) that respectively correspond to the first and second sample voltages related to the respective difference voltage (Vc). Each operator 32 is coupled to a respective analog to digital converter 31 for receiving the respective first and second voltage values (A, B) therefrom, and obtains a difference between the respective first and second voltage values to generate a respective difference voltage value (Vdif) that corresponds to the difference between the respective first and second sample voltages related respectively to the respective first and second voltage values (A, B) (e.g., Vdif=|A−B|). Each comparator 274 is coupled to a respective operator 32 for receiving the respective difference voltage value (Vdif) therefrom, is used to further receive a predetermined threshold voltage value (Vb), and compares the respective difference voltage value (Vdif) with the predetermined threshold voltage value (Vb) to generate a respective determination signal ($S2_1$-$S2_3$). The determination output includes the determination signals ($S2_1$-$S2_3$). In an example, like all previous examples, for each comparator 274, when the difference voltage value (Vdif) is not greater than the predetermined threshold voltage value (Vb), the determination signal ($S2_1$-$S2_3$) is at the logic low level; and when the difference voltage value (Vdif) is greater than the predetermined threshold voltage value (Vb), the determination signal ($S2_1$-$S2_3$) is at the logic high level.

The control circuit 30 is coupled to the current source 23 and the comparators 274, and is used to be coupled further to the display device 29. The control circuit 30 generates the control input (S3) for receipt by the current source 23, receives the determination signals ($S2_1$-$S2_3$) respectively from the comparators 274, and generates, for receipt by the display device 29, a detection output based on the determination signals ($S2_1$-$S2_3$) in such a way that the display device 29 can display the state (having failed or not having failed) of each LED 131.

In view of the above, for the fifth embodiment, by virtue of the determining circuit 24 that generates the determination output which indicates whether each LED 131 is determined to have failed, relevant personnel can be informed of possible occurrences of LED failures in order to have the failed LEDs 131 replaced in a timely fashion.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A light emitting diode (LED) failure detecting device operatively associated with an LED array, the LED array including a plurality of scan lines, a plurality of data lines, and a plurality of LED units that are arranged in a matrix with a plurality of rows and a plurality of columns, each of the LED units having a first terminal and a second terminal, and permitting current flow therethrough from the first terminal thereof to the second terminal thereof; for each of the rows of the LED units, the first terminals of the LED units being coupled to a respective one of the scan lines; for each of the columns of the LED units, the second terminals of the LED units being coupled to a respective one of the data lines; said LED failure detecting device comprising:

a driving circuit used to be coupled to the scan lines and the data lines, receiving a first control input that corresponds to selection of one of the LED units, and driving the LED units based on the first control input in such a way that a current flows through said one of the LED units; and a determining circuit used to be coupled to the data lines for receiving a plurality of first voltages respectively thereat, and further receiving a second control input that at least corresponds to selection of one of the data lines which is coupled to said one of the LED units, said determining circuit selecting, based on the second control input, one of the first voltages at said one of the data lines that is coupled to said one of the LED units, and generating, based on a difference between a first sample voltage that is related to at least the selected one of the first voltages at a first time point and a second sample voltage that is related to at least the selected one of the first voltages at a second time point, a determination output that indicates whether said one of the LED units is determined to have failed.

2. The LED failure detecting device of claim 1, further comprising a control circuit that is coupled to said driving circuit and said determining circuit;

for said one of the LED units, said control circuit generating the first control input for receipt by said driving circuit, generating the second control input for receipt by said determining circuit, receiving the determination output from said determining circuit, and generating a detection output based on the selection of said one of the LED units and on the determination output.

3. The LED failure detecting device of claim 1, wherein the first sample voltage is the selected one of the first voltages at the first time point, and the second sample voltage is the selected one of the first voltages at the second time point.

4. The LED failure detecting device of claim 3, wherein said determining circuit includes:

a multiplexer used to be coupled to the data lines for receiving the first voltages respectively thereat, further receiving the second control input, and outputting, based on the second control input to serve as the selected one of the first voltages, one of the first voltages at said one of the data lines that is coupled to said one of the LED units;

an analog to digital converter coupled to said multiplexer for receiving the selected one of the first voltages therefrom, and performing analog to digital conversion on the selected one of the first voltages to generate a first voltage value and a second voltage value that respectively correspond to the first and second sample voltages;

an operator coupled to said analog to digital converter for receiving the first and second voltage values therefrom, and obtaining a difference between the first and second voltage values to generate a difference voltage value that corresponds to the difference between the first and second sample voltages; and a comparator coupled to said operator for receiving the difference voltage value therefrom, used to further receive a predetermined threshold voltage value, and comparing the difference voltage value with the predetermined threshold voltage value to generate the determination output.

5. The LED failure detecting device of claim 1, wherein:

the second control input further corresponds to selection of one of the scan lines that is coupled to said one of the LED units;

said determining circuit is used to be coupled further to the scan lines for receiving a plurality of second voltages respectively thereat, and selects, based on the second control input, one of the second voltage at said one of the scan lines that is coupled to said one of the LED units;

the first sample voltage is related further to the selected one of the second voltages at the first time point; and the second sample voltage is related further to the selected one of the second voltages at the second time point.

6. The LED failure detecting device of claim 5, wherein the first sample voltage is a difference between the selected one of the first voltages and the selected one of the second voltages at the first time point, and the second sample voltage is a difference between the selected one of the first voltages and the selected one of the second voltages at the second time point.

7. The LED failure detecting device of claim 6, wherein the second control input includes a first control signal that corresponds to the selection of said one of the data lines which is coupled to said one of the LED units, and a second control signal that corresponds to the selection of said one of the scan lines which is coupled to said one of the LED units, and said determining circuit includes:

a first multiplexer used to be coupled to the data lines for receiving the first voltages respectively thereat, further receiving the first control signal, and outputting, based on the first control signal to serve as the selected one of the first voltages, one of the first voltages at said one of the data lines that is coupled to said one of the LED units;

a second multiplexer used to be coupled to the scan lines for receiving the second voltages respectively thereat, further receiving the second control signal, and outputting, based on the second control signal to serve as the selected one of the second voltages, one of the second voltage at said one of the scan lines that is coupled to said one of the LED units;

a subtractor coupled to said first and second multiplexers for receiving the selected one of the first voltages and the selected one of the second voltages respectively therefrom, and obtaining a difference between the selected one of the first voltages and the selected one of the second voltages to generate a difference voltage;

an analog to digital converter coupled to said subtractor for receiving the difference voltage therefrom, and performing analog to digital conversion on the difference voltage to generate a first voltage value and a second voltage value that respectively correspond to the first and second sample voltages;

an operator coupled to said analog to digital converter for receiving the first and second voltage values therefrom, and obtaining a difference between the first and second voltage values to generate a difference voltage value that corresponds to the difference between the first and second sample voltages; and a comparator coupled to said operator for receiving the difference voltage value therefrom, used to further receive a predetermined threshold voltage value, and comparing the difference voltage value with the predetermined threshold voltage value to generate the determination output.

8. The LED failure detecting device of claim 1, wherein the first control input includes a plurality of switching control signals and a plurality of current control signals, and said driving circuit includes:

a plurality of switches each having a first terminal that is used to receive a supply voltage, a second terminal that is used to be coupled to a respective one of the scan lines, and a control terminal that receives a respective one of the switching control signals; and a plurality of current sources, each of which receives a respective one of the current control signals, each of which generates a respective driving current signal based on the respective one of the current control signals, and each of which is used to be coupled to a respective one of the data lines for providing the driving current signal thereto.

9. A light emitting diode (LED) failure detecting device operatively associated with an LED unit, the LED unit having a first terminal and a second terminal, and permitting current flow therethrough from the first terminal thereof to the second terminal thereof, said LED failure detecting device comprising:

a driving circuit used to be coupled to the second terminal of the LED unit, receiving a control input, and driving the LED unit based on the control input in such a way that a current flows through the LED unit; and a determining circuit used to be coupled to the second terminal of the LED unit for receiving a first voltage thereat, and generating, based on a difference between a first sample voltage that is related to at least the first voltage at a first time point and a second sample voltage that is related to at least the first voltage at a second time point, a determination output that indicates whether the LED unit is determined to have failed.

10. The LED failure detecting device of claim 9, wherein the first sample voltage is the first voltage at the first time point, and the second sample voltage is the first voltage at the second time point.

11. The LED failure detecting device of claim 10, wherein said determining circuit includes:

an analog to digital converter used to be coupled to the second terminal of the LED unit for receiving the first voltage thereat, and performing analog to digital conversion on the first voltage to generate a first voltage value and a second voltage value that respectively correspond to the first and second sample voltages;

an operator coupled to said analog to digital converter for receiving the first and second voltage values therefrom, and obtaining a difference between the first and second voltage values to generate a difference voltage value that corresponds to the difference between the first and second sample voltages; and a comparator coupled to said operator for receiving the difference voltage value therefrom, used to further receive a predetermined threshold voltage value, and comparing the difference voltage value with the predetermined threshold voltage value to generate the determination output.

12. The LED failure detecting device of claim 9, further comprising a control circuit that is coupled to said driving circuit and said determining circuit;

said control circuit generating the control input for receipt by said driving circuit, receiving the determination output from said determining circuit, and generating a detection output based on the determination output.

13. The LED failure detecting device of claim 9, wherein:

said determining circuit is used to be coupled further to the first terminal of the LED unit for receiving a second voltage thereat;

the first sample voltage is related further to the second voltage at the first time point; and the second sample voltage is related further to the second voltage at the second time point.

14. The LED failure detecting device of claim 13, wherein the first sample voltage is a difference between the first and second voltages at the first time point, and the second sample voltage is a difference between the first and second voltages at the second time point.

15. The LED failure detecting device of claim 14, wherein said determining circuit includes:

a subtractor used to be coupled to the first and second terminals of the LED unit for receiving the first and second voltages respectively thereat, and obtaining a difference between the first and second voltages to generate a difference voltage;

an analog to digital converter coupled to said subtractor for receiving the difference voltage therefrom, and performing analog to digital conversion on the difference voltage to generate a first voltage value and a second voltage value that respectively correspond to the first and second sample voltages;

an operator coupled to said analog to digital converter for receiving the first and second voltage values therefrom, and obtaining a difference between the first and second voltage values to generate a difference voltage value that corresponds to the difference between the first and second sample voltages; and a comparator coupled to said operator for receiving the difference voltage value therefrom, used to further receive a predetermined threshold voltage value, and comparing the difference voltage value with the predetermined threshold voltage value to generate the determination output.

16. The LED failure detecting device of claim 9, wherein said driving circuit includes:

a current source receiving the control input, generating a driving current signal based on the control input, and used to be coupled to the second terminal of the LED unit for providing the driving current signal thereto.

17. A light emitting diode (LED) failure detecting device operatively associated with an LED unit, the LED unit including a first terminal, a second terminal, and a plurality of LEDs that are coupled in series between the first and second terminals thereof, the LED unit permitting current flow from the first terminal thereof through the LEDs thereof to the second terminal thereof, said LED failure detecting device comprising:

a driving circuit used to be coupled to the second terminal of the LED unit, receiving a control input, and driving the LED unit based on the control input in such a way that a current flows through the LED unit; and a determining circuit used to be coupled to the LEDs, generating a plurality of difference voltages that respectively correspond to respective voltages across the LEDs, and generating, based on a plurality of differences each between a respective first sample voltage that is a respective one of the difference voltages at a first time point and a respective second sample voltage that is the respective one of the difference voltages at a second time point, a determination output that indicates whether each of the LEDs is determined to have failed.

18. The LED failure detecting device of claim 17, each of the LEDs having an anode and a cathode, wherein:

said determining circuit includes a plurality of subtractors, each of which is used to be coupled to the anode and the cathode of a respective one of the LEDs for receiving two terminal voltages respectively thereat, and each of which obtains a difference between the terminal voltages to generate a respective one of the difference voltages that corresponds to the voltage across the respective one of the LEDs, a plurality of analog to digital converters, each of which is coupled to a respective one of said subtractors for receiving the difference voltage therefrom, and each of which performs analog to digital conversion on the respective one of the difference voltages to generate a respective first voltage value and a respective second voltage value that respectively correspond to the first and second sample voltages related to the respective one of difference voltages, a plurality of operators, each of which is coupled to a respective one of said analog to digital converters for receiving the respective first and second voltage values therefrom, and each of which obtains a difference between the respective first and second voltage values to generate a respective difference voltage value that corresponds to the difference between the first and second sample voltages related respectively to the respective first and second voltage values, and a plurality of comparators, each of which is coupled to a respective one of said operators for receiving the respective difference voltage value therefrom, each of which is used to further receive a predetermined threshold voltage value, and each of which compares the respective difference voltage value with the predetermined threshold voltage value to generate a respective determination signal; and the determination output includes the determination signals generated by said comparators.

19. The LED failure detecting device of claim 17, further comprising a control circuit that is coupled to said driving circuit and said determining circuit;

said control circuit generating the control input for receipt by said driving circuit, receiving the determination output from said determining circuit, and generating a detection output based on the determination output.

* * * * *